US008596758B2

(12) United States Patent
Hiraide

(10) Patent No.: US 8,596,758 B2
(45) Date of Patent: Dec. 3, 2013

(54) LIQUID EJECTION HEAD AND METHOD OF MANUFACTURING THE SAME

(75) Inventor: Hiroaki Hiraide, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/075,134

(22) Filed: Mar. 29, 2011

(65) Prior Publication Data

US 2011/0242217 A1 Oct. 6, 2011

(30) Foreign Application Priority Data

Mar. 30, 2010 (JP) ..... 2010-077380

(51) Int. Cl.
*B41J 2/14* (2006.01)

(52) U.S. Cl.
USPC ..... 347/47; 347/40; 347/43; 347/12

(58) Field of Classification Search
USPC ..... 347/47, 40, 43, 12
See application file for complete search history.

(56) References Cited

U.S. PATENT DOCUMENTS

| | | | | |
|---|---|---|---|---|
| 6,045,214 | A | 4/2000 | Murthy et al. | |
| 6,270,191 | B1 * | 8/2001 | Morikoshi et al. | 347/44 |
| 2005/0001879 | A1 | 1/2005 | Miyajima et al. | |
| 2005/0012781 | A1 | 1/2005 | Miura et al. | |
| 2006/0152549 | A1 * | 7/2006 | Asuke | 347/45 |
| 2008/0030545 | A1 * | 2/2008 | Iijima | 347/43 |

FOREIGN PATENT DOCUMENTS

| | | | |
|---|---|---|---|
| CN | 1197732 | A | 11/1998 |
| CN | 1550337 | A | 12/2004 |
| CN | 1572504 | A | 2/2005 |
| CN | 1803455 | A | 7/2006 |
| CN | 101121341 | A | 2/2008 |
| JP | H05-193140 | A | 8/1993 |
| JP | H09-118012 | A | 5/1997 |
| JP | H11-277756 | A | 10/1999 |
| JP | 2001-030490 | A | 2/2001 |
| JP | 2003-276204 | A | 9/2003 |
| JP | 2004-042433 | A | 2/2004 |
| JP | 2006-264147 | A | 10/2006 |
| JP | 2006-334910 | A | 12/2006 |
| JP | 2009-248444 | A | 10/2009 |

OTHER PUBLICATIONS

Japan Patent Office, Notification of Reason for Refusal for Japanese Patent Application No. 2010-077380 (counterpart Japanese patent application), dispatched Aug. 21, 2012.

State Intellectual Property Office of the People'S Republic of China, Notification of First Office Action for Chinese Patent Application No. 201110084166.2 (counterpart to above-captioned patent application), mailed Apr. 15, 2013.

* cited by examiner

*Primary Examiner* — Henok Legesse
(74) *Attorney, Agent, or Firm* — Baker Botts L.L.P.

(57) ABSTRACT

A liquid ejection head including: a base plate member having ejection holes and an ejection face having ejection openings; and an actuator; wherein the ejection face has first and second recessed portions extending in one direction and arranged in a perpendicular direction, wherein the ejection openings are formed in bottom portions of the respective first recessed portions; wherein each second recessed portion and a corresponding first recessed portion are arranged side by side such that a separation distance therebetween is not smaller than a separation distance between two first recessed portions located side by side at the shortest distance among first recessed portions and is shorter than a separation distance between two first recessed portions located side by side at the greatest distance among the first recessed portions; and wherein on the bottom portions is formed a liquid repellent layer having not been removed due to a masking material having entered into the first recessed portions to cover the liquid repellent layer.

12 Claims, 8 Drawing Sheets

LIQUID EJECTION HEAD AND METHOD OF MANUFACTURING THE SAME

CROSS REFERENCE TO RELATED APPLICATION

The present application claims priority from Japanese Patent Application No. 2010-077380, which was filed on Mar. 30, 2010, the disclosure of which is herein incorporated by reference in its entirety.

BACKGROUND OF THE INVENTION

1. Field of the Invention

The present invention relates to a liquid ejection head having an ejection face in which are formed ejection openings for ejecting liquid droplets and to a method of manufacturing the liquid ejection head.

2. Description of the Related Art

There is an ink-jet head having an ejection face in which a water repellent layer is formed on peripheries of nozzle openings in order to enhance ink ejection properties. In such an ink-jet head, there is known a technique that the nozzle openings are formed in a bottom portion of each of elongated holes formed in the ejection face in order to protect the water repellent layer from a wiper for wiping the ink-ejection face.

SUMMARY OF THE INVENTION

In a process of manufacturing such an ink-jet head, when the water repellent layer is formed on the ink-ejection face, an unnecessary water repellent layer may be formed in each nozzle. Thus, only the ink-ejection face is masked by covering the ink-ejection face with a masking material, and then the unnecessary water repellent layer in each nozzle is removed. In the above-described technique, shapes and positional relationships of the elongated holes formed in the ejection face may cause unequal or different amounts of the masking material entering into the respective elongated holes when the ejection face is covered with the masking material. In the case where the amounts of the masking material entering into the respective elongated holes are unequal, it is difficult to accurately adjust a pressure at which the masking material is bonded to the ejection face such that the masking material does not enter into each nozzle. This makes it difficult to accurately remove only the water repellent layer formed in each nozzle. Where the water repellent layer unequally remains in the nozzle, variations in ejection properties are caused among the nozzles, leading to a deterioration of a recording property.

This invention has been developed in view of the above-described situations, and it is an object of the present invention to provide a liquid ejection head which can reduce variations in liquid ejection properties among ejection openings and a method of manufacturing the liquid ejection head.

The object indicated above may be achieved according to the present invention which provides a liquid ejection head comprising: a base plate member; and an actuator configured to apply liquid ejection energy to liquid in the base plate member; wherein the base plate member has (a) a plurality of ejection holes formed in a thickness direction of the base plate member and (b) an ejection face having a plurality of ejection openings opened therein, wherein liquid droplets are ejected through the plurality of ejection holes and the plurality of ejection openings; wherein the ejection face has a plurality of first recessed portions and a plurality of second recessed portions each of which extends in one direction and which are formed in the ejection face so as to be arranged in parallel with one another in a recessed-portions arranged direction that is perpendicular to the one direction, wherein the plurality of ejection openings are formed in bottom portions of the respective first recessed portions; wherein each of the plurality of second recessed portions and a corresponding one of the plurality of first recessed portions are arranged side by side such that a separation distance therebetween in the recessed-portions arranged direction is equal to or greater than a separation distance in the recessed-portions arranged direction between two first recessed portions located side by side at the shortest distance among the plurality of first recessed portions and is shorter than a separation distance in the recessed-portions arranged direction between two first recessed portions located side by side at the greatest distance among the plurality of first recessed portions; and wherein on the bottom portions of the respective first recessed portions is formed a liquid repellent layer which has not been removed due to a masking material having entered into the first recessed portions to cover the liquid repellent layer.

The object indicated above may also be achieved according to the present invention which provides a method of manufacturing a liquid ejection head, the liquid ejection head comprising: a base plate member having (a) a plurality of ejection holes formed in a thickness direction of the base plate member and (b) an ejection face having a plurality of ejection openings opened therein, wherein liquid droplets are ejected through the plurality of ejection holes and the plurality of ejection openings; and an actuator configured to apply liquid ejection energy to liquid in the base plate member, the method comprising: a base-member forming step of forming, in the base plate member, (a) a plurality of first recessed portions and a plurality of second recessed portions each of which extends in one direction and which are formed in the ejection face so as to be arranged in parallel with one another in a recessed-portions arranged direction that is perpendicular to the one direction, and (b) the plurality of ejection holes respectively communicating with the plurality of ejection openings opened in bottom portions of the respective first recessed portions; a liquid-repellent-layer forming step of forming a liquid repellent layer on the ejection face in which the plurality of first recessed portions and the plurality of second recessed portions are formed; a compression-bonding step of compressing and bonding a masking material to the ejection face such that the masking material enters into the first recessed portions; a liquid-repellent-layer removing step of removing the liquid repellent layer which is not covered by the masking material; and thereafter a masking-material removing step of removing the masking material from the base plate member, wherein the base-member forming step is a step of forming each of the plurality of second recessed portions and a corresponding one of the plurality of first recessed portions so as to be arranged side by side such that a separation distance therebetween in the recessed-portions arranged direction is equal to or greater than a separation distance in the recessed-portions arranged direction between two first recessed portions located side by side at the shortest distance among the plurality of first recessed portions and is shorter than a separation distance in the recessed-portions arranged direction between two first recessed portions located side by side at the greatest distance among the plurality of first recessed portions.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
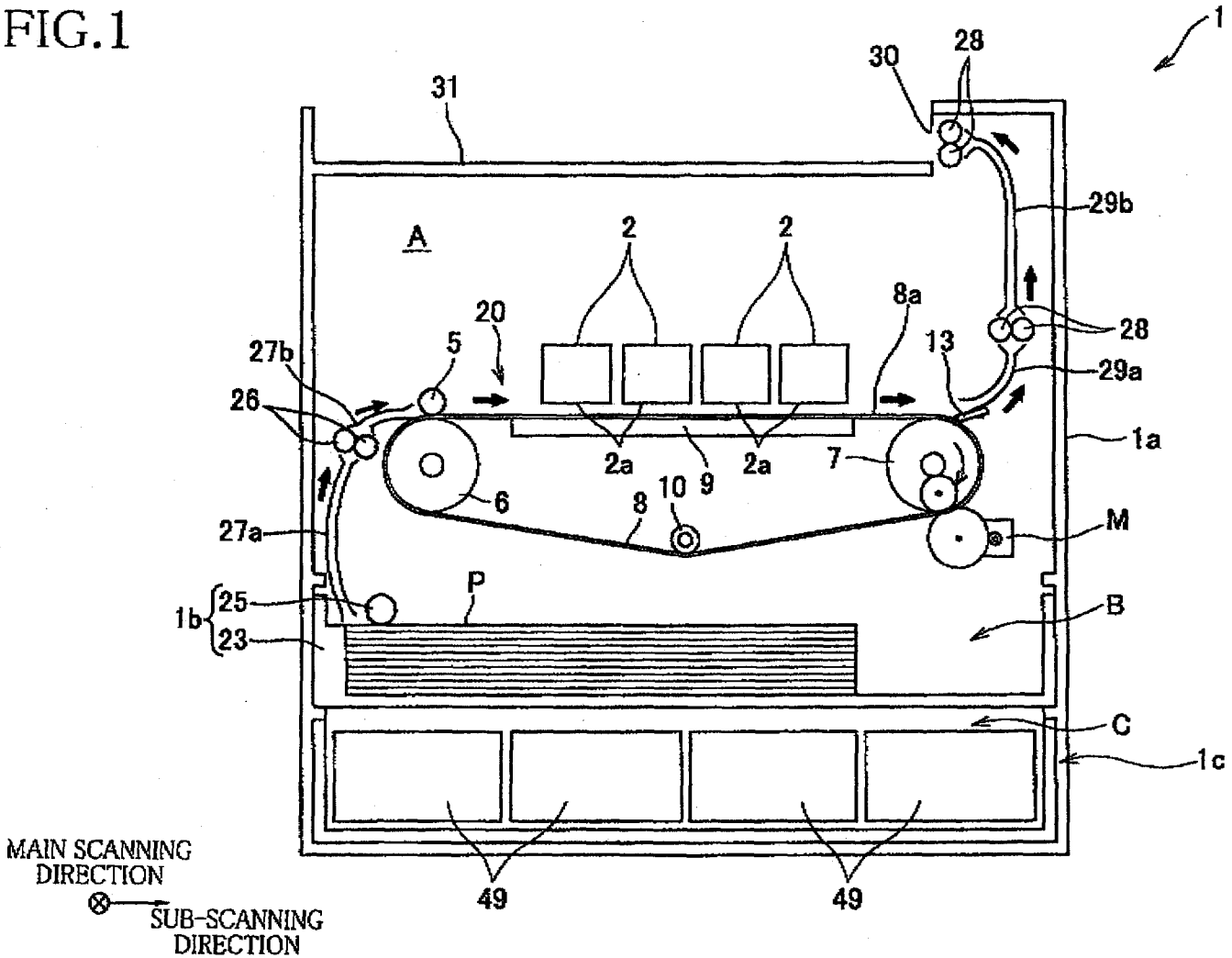
FIG. 1 is a schematic view showing an internal structure of an ink-jet printer as an embodiment of the present invention.

An ink-jet printer 1 is a color ink jet printer of a line type. As shown in FIG. 1, the printer 1 includes a casing la having a rectangular parallelepiped shape, A sheet-discharge portion 31 is provided at an upper portion of the casing 1*a*. An inside of the casing la is divided into three spaces A, B, and C in order from an upper side thereof. Each of the spaces A and B is a space in which a sheet feeding path continued to the sheet-discharge portion 31 is defined. In the space A, a sheet is fed and an image is recorded on the sheet. In the space B, the sheet or sheets are accommodated and each sheet is supplied to the space A, In the space C, an ink supply source is accommodated, allowing inks to be supplied.

In the space A, there are disposed (a) four ink-jet heads 2, (b) a sheet-feed unit 20 configured to feed the sheet, (c) guide portions for guiding the sheet, and so on. Each of the four heads 2 is a line-type head elongated in a main scanning direction as one example of one direction and having a generally rectangular parallelepiped shape as an external shape. The heads 2 respectively have lower faces as ink-ejection faces 2*a* from which inks of four colors, namely, magenta, cyan, yellow, and black are respectively ejected as ink droplets. The heads 2 are arranged so as to be spaced at predetermined pitches in a sub-scanning direction which is perpendicular to the main scanning direction (that is, the sub-scanning direction corresponds to a recessed-portions arranged direction that is perpendicular to the one direction).

As shown in FIG. 1, the sheet-feed unit 20 includes (a) belt rollers 6, 7, (b) an endless sheet-feed belt 8 wound around the rollers 6, 7, (c) a nip roller 5 and a peeling plate 13 disposed on an outside of the sheet-feed belt 8 in the sub-scanning direction, (d) a platen 9 and a tension roller 10 disposed on an inside of the sheet-feed belt 8 in the sub-scanning direction, and so on. The belt roller 7 is a drive roller which is rotated by a feeding motor M in a clockwise direction in FIG. 1. During the rotation of the belt roller 7, the sheet-feed belt 8 is rotated or circulated along bold arrow shown in FIG. 1. The belt roller 6 is a driven roller which is rotated in the clockwise direction in FIG. 1 with the rotation of the sheet-feed belt 8. The nip roller 5 is disposed so as to face the belt roller 6 and configured to press each sheet P supplied from a sheet-supply unit 1*b* along an upstream guide portion, onto an outer circumferential face 8*a* of the sheet-feed belt 8. The peeling plate 13 is disposed so as to face the belt roller 7 and configured to peel each sheet P from the outer circumferential face 8*a* to feed or convey each sheet P to a downstream guide portion. The platen 9 is disposed so as to face the four heads 2 and supports an upper portion of the sheet-feed belt 8 from an inside thereof. As a result, a space suitable for an image recording is formed between the outer circumferential face 8*a* and the ink-ejection faces 2*a* of the respective heads 2. The tension roller 10 presses or urges a lower portion of the belt roller 7 downward, which removes slack of the sheet-feed belt 8.

The guide portions are arranged on opposite sides of the sheet-feed unit 20 in the sub-scanning direction. The upstream guide portion includes guides 27*a*, 27*b* and a pair of sheet-feed rollers 26. This upstream guide portion connects the sheet-supply unit 1*b* and the sheet-feed unit 20 to each other. The downstream guide portion includes guides 29*a*, 29*b* and two pairs of sheet-feed rollers 28. This downstream guide portion connects the sheet-feed unit 20 and the sheet-discharge portion 31 to each other.

The sheet-supply unit 1*b* is disposed in the space B. The sheet-supply unit 1*b* includes a sheet-supply tray 23 and a sheet-supply roller 25. The sheet-supply tray 23 can be mounted on and removed from the casing 1*a*. The sheet-supply tray 23 has a box-like shape opening upward so as to accommodate a plurality of sheets P. The sheet-supply roller 25 supplies, to the upstream guide portion, an uppermost one of the sheets P accommodated in the sheet-supply tray 23.

As described above, in the space A and the space B is formed the sheet feeding path extending from the sheet-supply unit 1*b* to the sheet-discharge portion 31 via the sheet-feed unit 20. The sheet P supplied from the sheet-supply tray 23 is fed along the guides 27*a*, 27*b* to the sheet-feed unit 20 by the sheet-feed rollers 26. When the sheet P is fed in the sub-scanning direction through a position just below the heads 2, the ink droplets are ejected in order from the heads 2 to record or form a color image on the sheet P. The sheet P is peeled at a right end of the sheet-feed belt 8 and fed upward along the guides 29*a*, 29*b* by the two sheet-feed rollers 28. The sheet P is then discharged onto the sheet-discharge portion 31 through an opening 30.

Here, the sub-scanning direction is parallel to a sheet feeding direction in which the sheet P is fed by the sheet-feed unit 20, and the main scanning direction is parallel to a horizontal plane and perpendicular to the sub-scanning direction.

In the space C, there is disposed an ink tank unit 1*c* which can be mounted on and removed from the casing 1*a*. The ink tank unit le accommodates therein four ink tanks 49 arranged in a row. The respective inks in the ink tanks 49 are supplied to the heads 2 through tubes, not shown.

There will be next explained the heads 2 with reference to FIGS. 2-6. It is noted that, in FIG. 3, pressure chambers 110, apertures 112, and nozzle holes 108 illustrated by solid lines for easier understanding purposes although these elements are located under actuator units 21 and accordingly should be illustrated by broken lines. Further, since the four heads 2 have the same configuration, an explanation is given for one of the heads 2 for the sake of simplicity.

Figure 2:
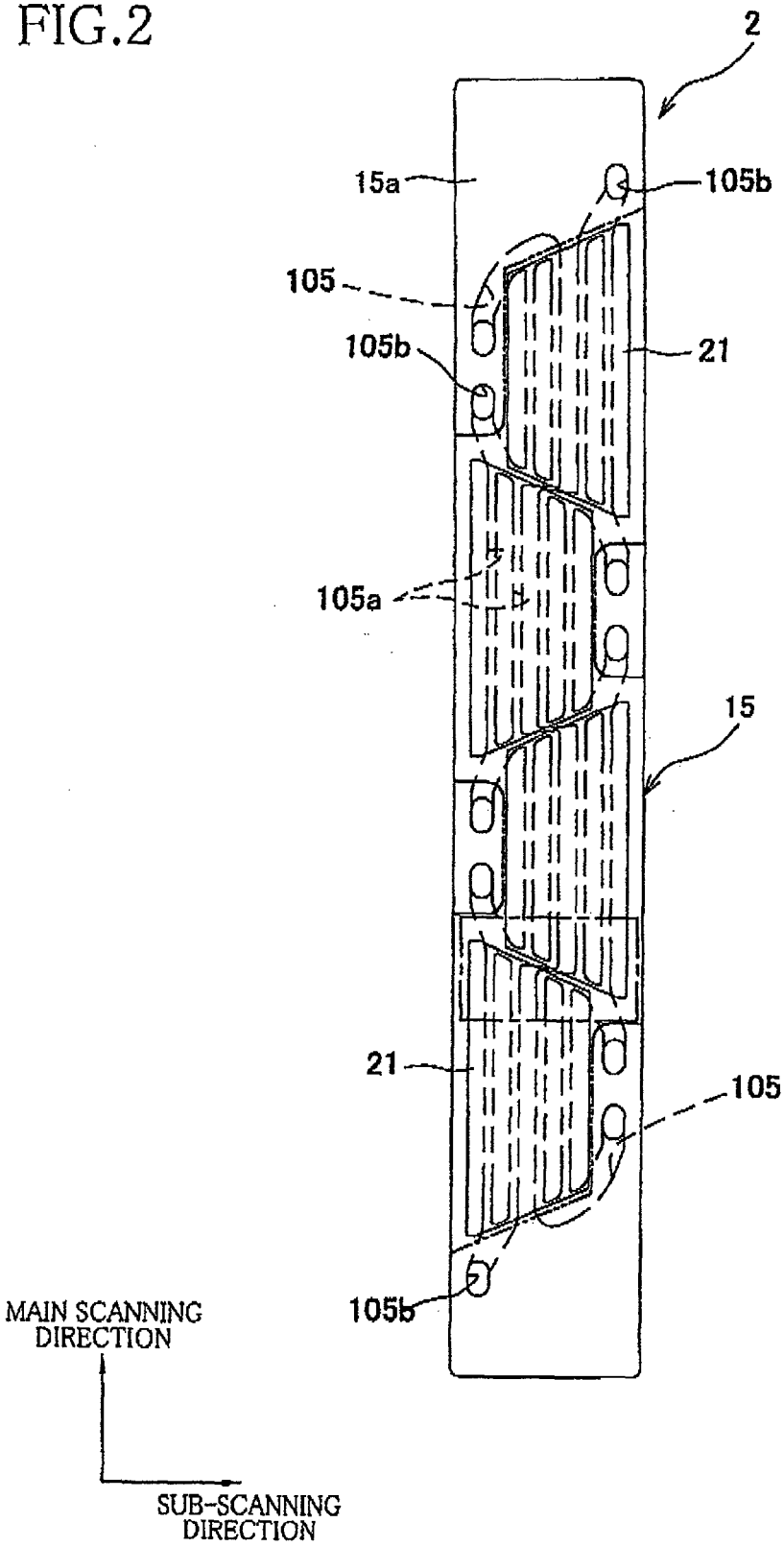
FIG. 2 is a view showing an upper face of an ink-jet head shown in FIG. 1.
Figure 3:
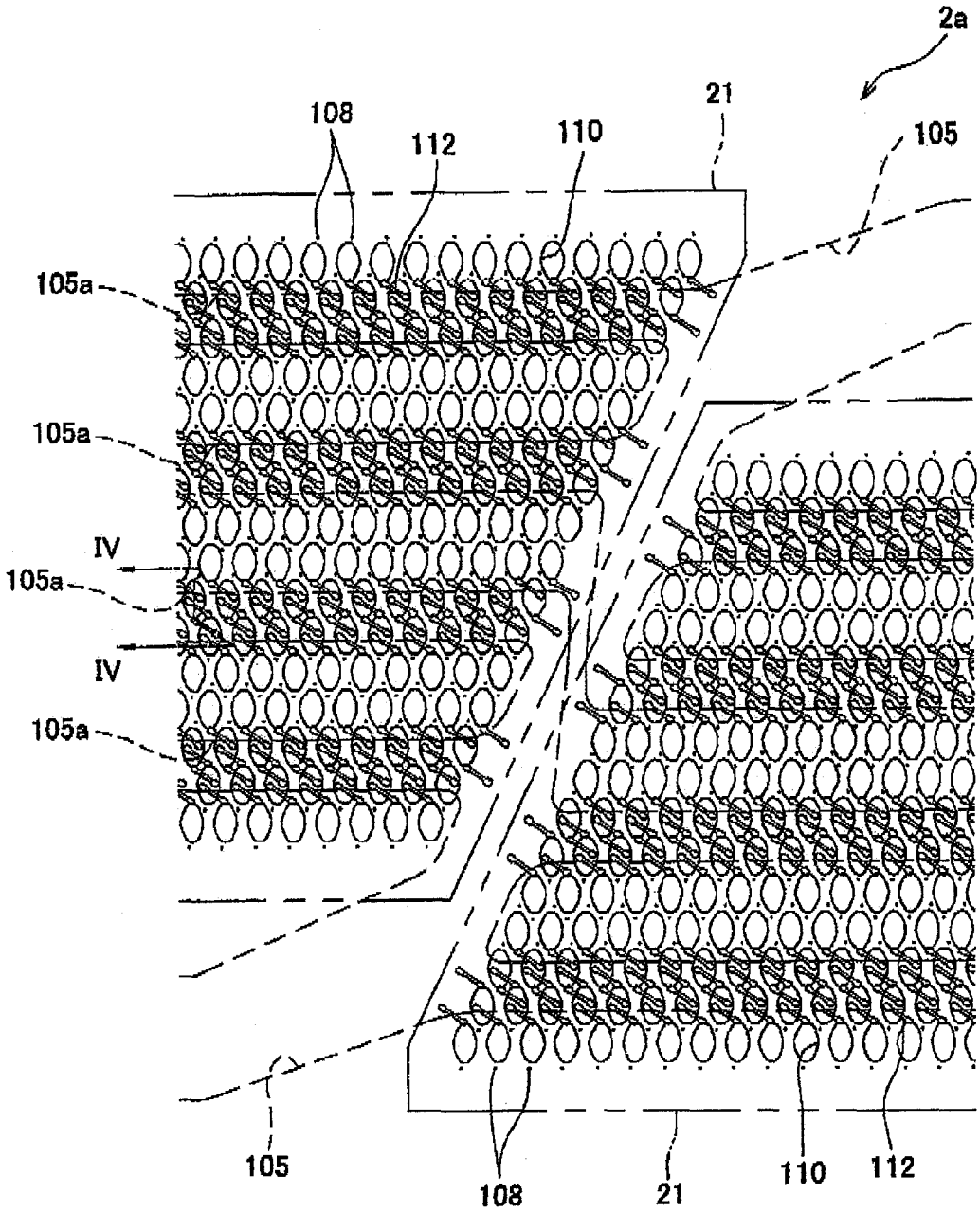
FIG. 3 is an enlarged view of an area enclosed by a one-dot chain line shown in FIG. 2.
Figure 4:
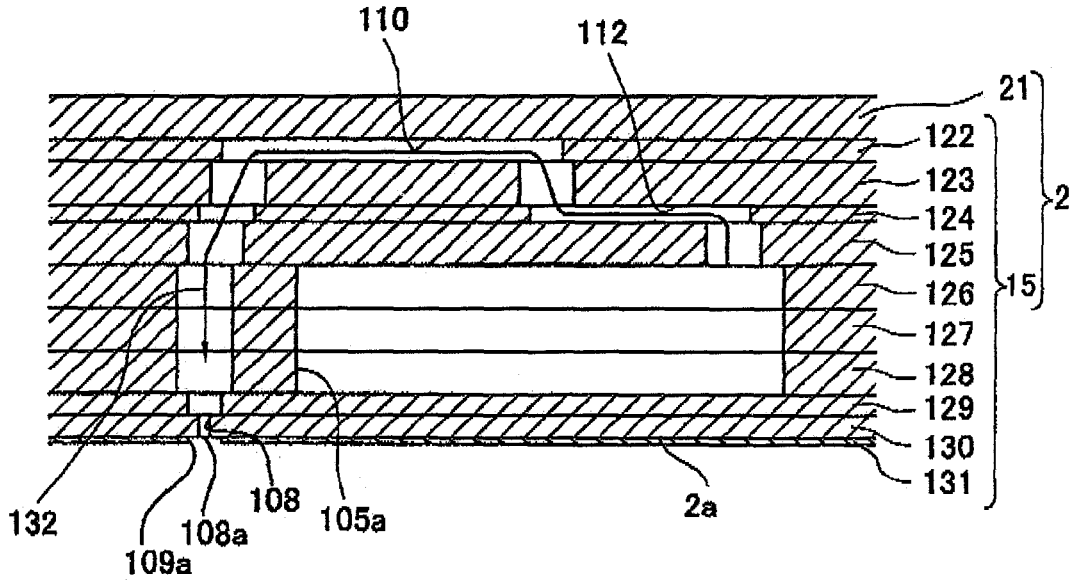
FIG. 4 is a cross-sectional view taken along a line IV-IV in FIG. 3.

As shown in FIG. 2, the four actuator units 21 are fixed to an upper face 15*a* of a channel unit 15 as one example of a base plate member. As shown in FIGS. 3 and 4, in the channel unit 15, there are formed ink channels having a plurality of the pressure chambers 110 and so on. Each of the actuator units 21 includes a plurality of actuators respectively corresponding to the pressure chambers 110 and has a function for selectively applying liquid ejection energy to the ink in the pressure chambers 110 by being driven by a driver IC, not shown.

The channel unit 15 has a rectangular parallelepiped shape. The upper face 15*a* of the channel unit 15 has ten ink-supply openings 105*b* opened therein to which the ink is supplied from an ink reservoir, not shown. As shown in FIGS. 2 and 3, in the channel unit 15, there are formed (a) manifold channels 105 each of which communicates with corresponding two of ink-supply openings 105*b* and (b) sub-manifold channels 105*a* branched from each manifold channel 105. A lower face of the channel unit 15 functions as the ink-ejection face 2*a* in which a multiplicity of ink-ejection openings 108*a* (openings of the respective nozzle holes 108 each as one example of an ejection hole) are formed so as to be arranged in matrix. Likewise, a multiplicity of the pressure chambers 110 are formed in the upper face 15*a* of the channel unit 15 so as to be arranged in matrix.

Figure 6:
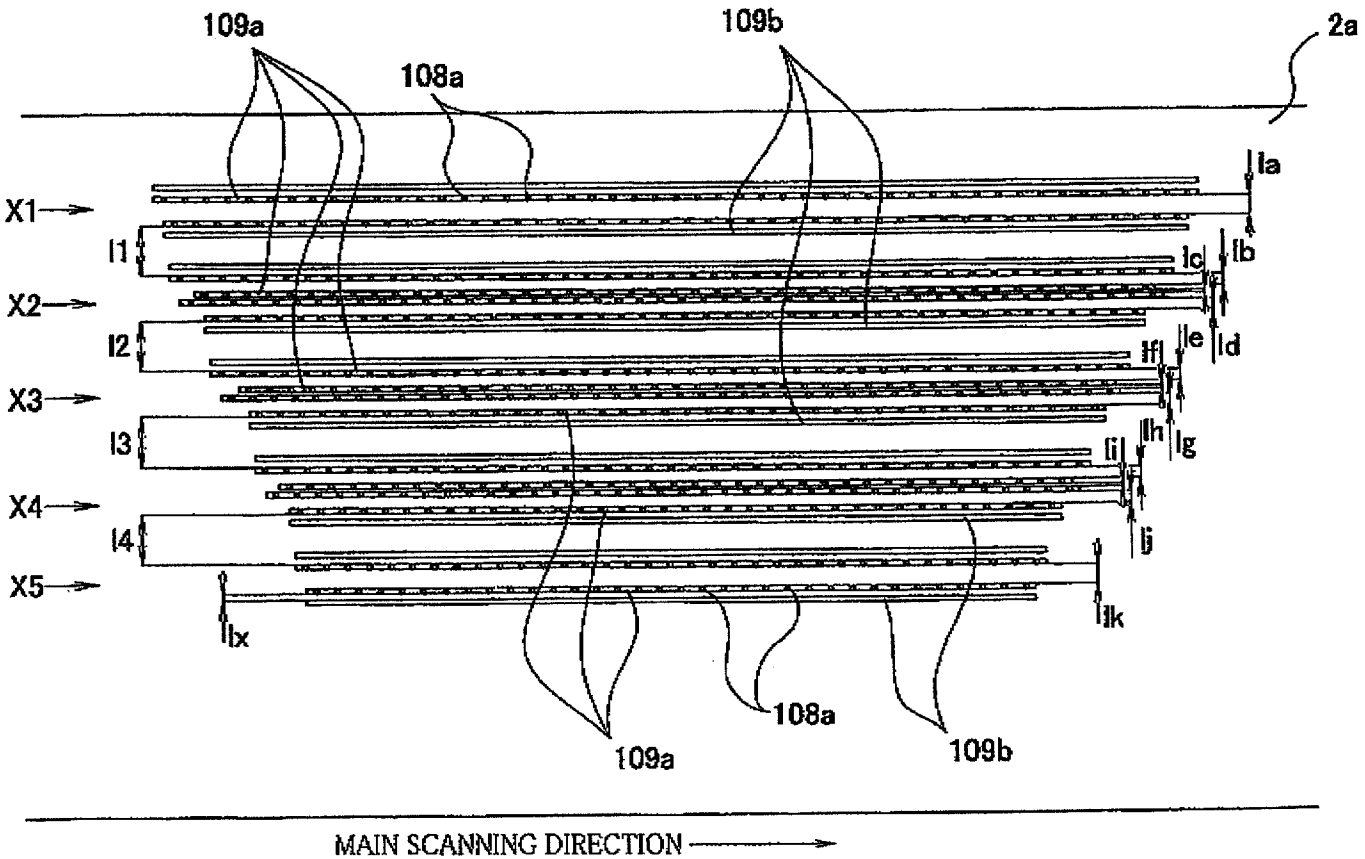
FIG. 6 is a partly enlarged view of an ink-ejection face shown in FIG. 4.

In the present embodiment, the pressure chambers 110 formed in an area opposed to each of the actuator units 21 constitute sixteen pressure-chamber rows in each of which the pressure chambers 110 are arranged in the main scanning direction so as to be equally spaced from one another. These pressure-chamber rows are arranged in parallel in the sub-scanning direction. In correspondence with an outer shape (a trapezoid shape) of each of the actuator units 21, the number of the pressure chambers 110 included in each of the pressure-chamber rows gradually decreases from a longer side toward a shorter side of the trapezoid shape of each actuator unit 21. The ink-ejection opening 108*a* are also arranged in a manner similar to the manner of the arrangement of the pressure chambers 110. Thus, as shown in FIG. 6, in correspondence with the pressure chamber rows, the ink-ejection openings 108*a* formed in the ink-ejection face 2*a* constitute sixteen ink-ejection-opening rows in which the ink-ejection openings 108*a* are arranged in the main scanning direction. The ink-ejection-opening rows are arranged in parallel in the sub-scanning direction.

As shown in FIG. 4, the channel unit 15 is constituted by nine plates 122-130 and a plated layer 131. Each of the nine plates 122-130 is formed of a metal material such as stainless steel, and the plated layer 131 formed of nickel is formed on a surface of the plate 130. Each of the plates 122-130 and the plated layer 131 has a rectangular flat face elongated in the main scanning direction.

Through holes formed through the respective plates 122-130 are communicated with one another by stacking the plates 122-130 on one another while positioning. As a result, in the channel unit 15, there are formed a multiplicity of individual ink channels 132 extending from the four manifold channels 105 to the ink-ejection openings 108*a* of the nozzle holes 108 via the sub-manifold channels 105*a*, outlets of the respective sub-manifold channels 105*a*, and the pressure chambers 110.

The ink supplied from the ink reservoir into the channel unit 15 via ink-supply openings 105*b* is diverted from the manifold channels 105 into the sub-manifold channels 105*a*. The ink in the sub-manifold channels 105*a* flows into each of the individual ink channels 132 and reaches a corresponding one of the nozzle holes 108 via a corresponding one of the apertures 112 each functioning as a restrictor and via a corresponding one of the pressure chambers 110.

Figure 5:
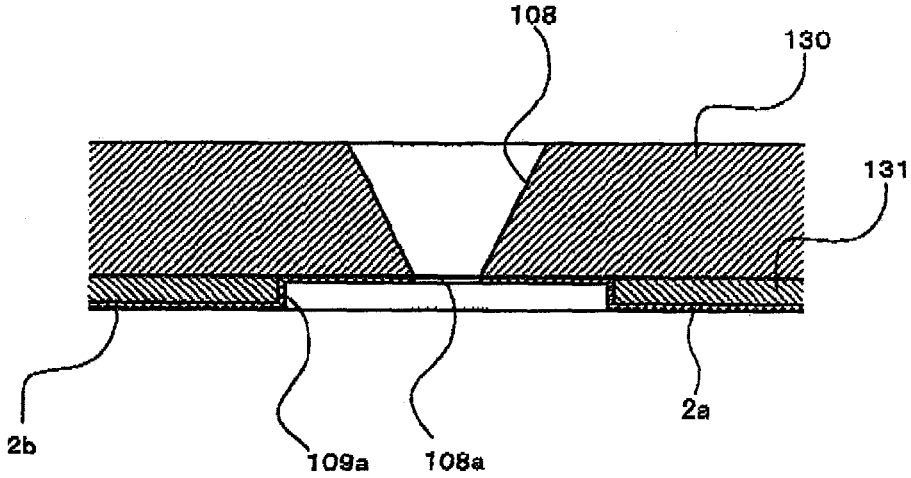
FIG. 5 is an enlarged cross-sectional view of a nozzle hole shown in FIG. 4.

A lower face of the nozzle plate 130 which faces the sheet P being fed is the ink-ejection face 2*a*. As shown in FIGS. 5 and 6, sixteen grooves 109*a* each as one example of a first recessed portion and ten dummy grooves 109*b* each as one example of a second recessed portion are formed in the ink-ejection face 2*a* so as to extend in the main scanning direction. Each of the grooves 109*a* and the dummy grooves 109*b* has a specific width (160 μm in the present embodiment) in the sub-scanning direction. The grooves 109*a* and the dummy grooves 109*b* are arranged in parallel in the sub-scanning direction. On a bottom portion of each of the grooves 109*a* (i.e., on a portion defining a bottom of each groove 109*a*), the ink-ejection openings 108*a* are arranged in the main scanning direction so as to provide a single ink-ejection-opening row. Each groove 109*a* is defined by the lower face of the nozzle plate 130 and an inner wall face of an elongated hole of the plated layer 131, the elongated hole exposing the ink-ejection-opening row. The dummy grooves 109*b* is defined by the lower face of the nozzle plate 130 and the inner wall face of the elongated hole of the plated layer 131. Further, a water repellent layer 2*b* is formed on an entire of the ink-ejection face 2*a* including the respective bottom portions of the grooves 109*a* and the dummy grooves 109*b*. It is noted that a thickness of the plated layer 131 (i.e., a depth of the grooves 109*a* and the dummy grooves 109*b*) is 3 μm.

In an area of the ink-ejection face 2*a* which faces the actuator unit 21, there are arranged in order from one side (an upper side in FIG. 6) in the sub-scanning direction (a) a groove group X1 constituted by two grooves 109*a*, (b) three groove groups X2-X4 each constituted by four grooves 109*a*, and (c) a groove group X5 constituted by two grooves 109*a*. Each of separation distances l1-l4 between adjacent two of the groove groups X1-X5 in the sub-scanning direction is greater than any of separation distances la-lk each between adjacent two of the grooves 109*a* of a corresponding one of the groove groups X1-X5 in the sub-scanning direction. In other words, the greatest or longest ones of the separation distances between each pair of the grooves 109*a* located side by side among the plurality of the grooves 109*a* are the separation distances l1-l4. It is noted that the separation distance between the two grooves 109*a* located side by side among the plurality of the grooves 109*a* is the separation distance between the two grooves 109*a* in a state in which the dummy grooves 109*b* are not formed. It is noted that the separation distance lc is the smallest among the separation distances la-lk. It is further noted that each of the separation distances lf, li is generally equal to the separation distance lc in the present embodiment. Further, the separation distance lx is smaller or shorter than each of the separation distances l1-l4 that is the largest value among pairs of the grooves 109 adjacent to each other among the plurality of grooves 109*a*.

On opposite sides of each of the groove groups X1-X5 in the sub-scanning direction are arranged two of the dummy grooves 109*b*. Each of the dummy grooves 109*b* extends in the main scanning direction in parallel with an adjacent one of the grooves 109*a* in the sub-scanning direction so as to have the same length as the adjacent groove 109*a* in the main scanning direction. A distance between each dummy groove 109*b* and the corresponding adjacent groove 109*a* in the sub-scanning direction is a separation distance lx. Further, the separation distance lx is the same as the separation distance in between the adjacent two of the grooves 109*a* of the groove group X2 in the sub-scanning direction.

Figure 7:
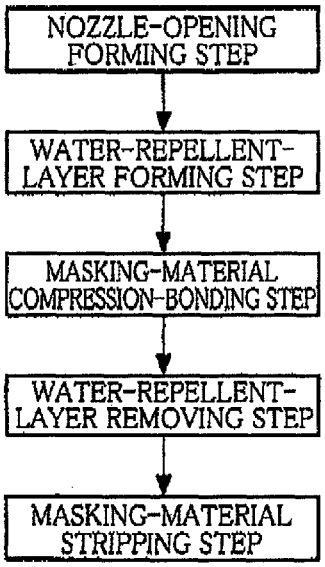
FIG. 7 is a block diagram showing a process of manufacturing the ink-jet head shown in FIG. 1.

There will be next explained a method of manufacturing the head 2, concentrating on a step for forming the nozzle plate 130 as one example of a base-member forming step. As shown in FIG. 7, the method of manufacturing the head 2 includes a nozzle-opening forming step (process), a water-repellent-layer forming step (process) as one example of a liquid-repellent-layer forming step, a masking-material compression-bonding step (process) as one example of a compression-bonding step, a water-repellent-layer removing step (process) as one example of a liquid-repellent-layer removing step, and a masking-material stripping step (process) as one example of a masking-material removing step.

Figure 8A:
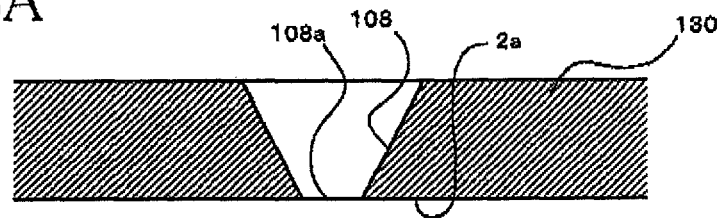
FIGS. 8A-8D are views for explaining the process of manufacturing the ink-jet head shown in FIG. 4.
Figure 8B:
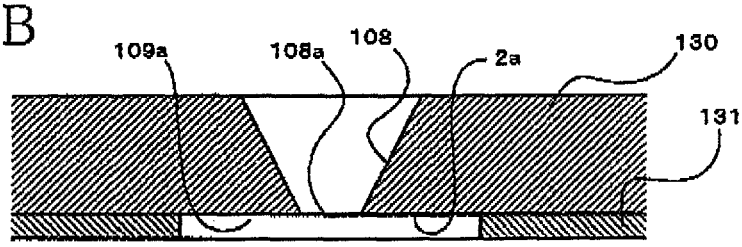

As shown in FIG. 8A, in the nozzle-opening forming step, each nozzle hole 108 is formed through a metal plate-like base material for forming the nozzle plate 130, so as to be tapered toward the ink-ejection face 2*a*. Each nozzle hole 108 is formed by (a) a press working from a back face (i.e., an upper face in FIG. 8A) of the nozzle plate 130 by using a punch and (b) a polish working for a front face (i.e., the ink-ejection face 2*a* or a lower face in FIG. 8A) of the nozzle plate 130. Each nozzle hole 108 has a diameter of 20 μm, for example. Further, as shown in FIG. 8B, the nickel plated layer 131 is formed on the ink-ejection face 2*a* (having the ink-ejection opening 108*a* opened therein) of the plate-like base material in which the nozzle hole 108 is formed. Prior to forming the plated layer 131, resist films each having a planar shape of the groove 109*a* or the dummy groove 109*b* are formed on the ink-ejection face 2*a*. Each of the resist films for the grooves 109*a* has a width (in a widthwise direction thereof or the sub-scanning direction) of 160 μm and covers a corresponding one of the ink-ejection-opening rows. From the viewpoint of preventing foreign materials from entering into the ink-ejection openings 108*a* during wiping of a wiper, opposite outermost ink-ejection openings 108*a* in the direction in which each ink-ejection-opening row extends (i.e., the main scanning direction and a direction in which the wiper wipes or moves) are located inside opposite ends of the corresponding resist film covering the ink-ejection-opening row by about 200 μm in the main scanning direction. The resist films for the grooves 109*a* constitute six groups in correspondence with the arrangement of the ink-ejection-opening rows. Each of the resist films for the dummy grooves 109*b* has a width of 160 μm. The resist films for the dummy grooves 109*b* partly cover the ink-ejection face 2*a* such that each of the groups of the resist films for the grooves 109*a* is interposed between corresponding two of the resist films for the dummy grooves 109*b* in the sub-scanning direction. A distance between each of the resist films for the dummy grooves 109*b* and a corresponding one of the resist films for the grooves 109*a* which is the nearest to each of the resist films for the dummy grooves 109*b* is the separation distance lc. In this arrangement, the plated layer 131 is formed by an electrolytic plating method. After this plating processing, the plated layer 131 has (a) a plurality of elongated holes respectively for the ink-ejection-opening rows and (b) a plurality of holes for partly exposing the ink-ejection face 2*a*. As a result, the grooves 109*a* and the dummy grooves 109*b* are formed in the ink-ejection face 2*a*.

Figure 8C:
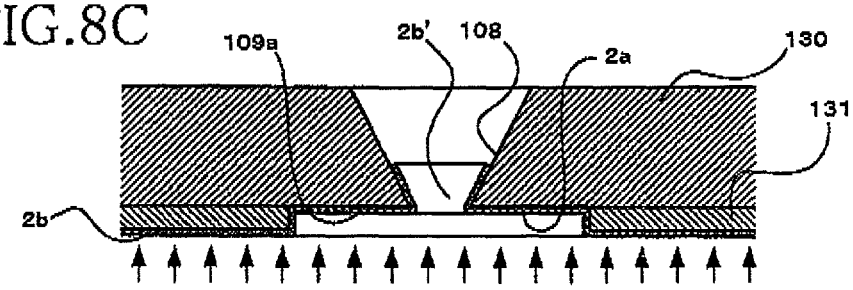

As shown in FIG. 8C, in the water-repellent-layer forming step, a water repellent agent is applied, by spraying, from a position facing the ink-ejection face 2*a* (i.e., from a side of the ink-ejection face 2*a* which is further from the nozzle hole 108) to the ink-ejection face 2*a* in which the grooves 109*a* and the dummy grooves 109*b* are formed in the nozzle-opening forming step, and then a heat treatment is applied to the nozzle plate 130, thereby forming the water repellent layer 2*b* on the ink-ejection face 2*a*. In applying the water repellent agent (i.e., a water-repellent-agent applying step), part of the water repellent agent enters into the nozzle holes 108 through the respective ink-ejection openings 108*a*, whereby a water repellent layer 2*b*' is formed partly on inner wall face of each nozzle hole 108. This water repellent layer 2*b*' is formed unequally on the inner wall face of each nozzle hole 108, which may cause variations in ink ejection properties. It is noted that the water repellent layer 2*b* may be formed by a physical vapor deposition (evaporating) or a chemical vapor deposition (evaporating).

Figure 8D:
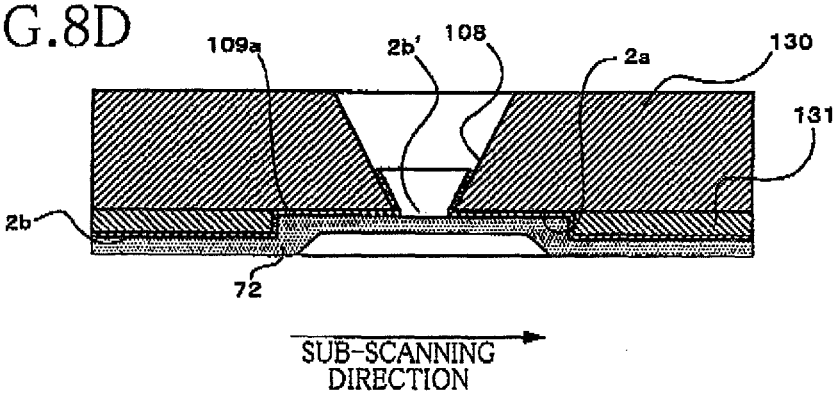
Figure 9:
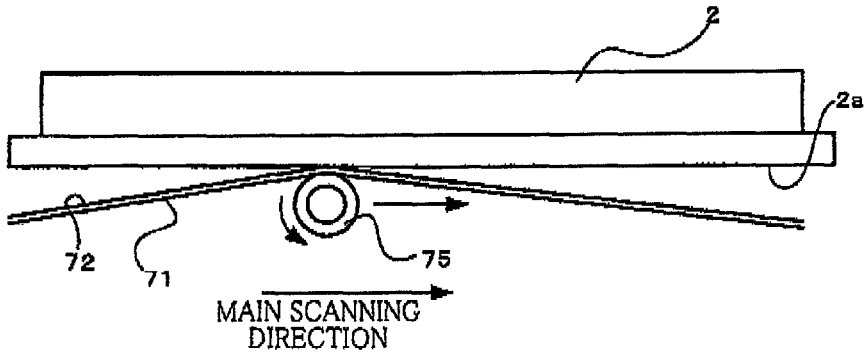
FIG. 9 is a view for explaining a masking-material compression-bonding step shown in FIG. 7.

As shown in FIG. 8D, in the masking-material compression-bonding step, a masking material 72 and the ink-ejection face 2*a* on which the water repellent layer 2*b* is formed are compressed and bonded together. Specifically, as shown in FIG. 9, this compression bonding of the masking material 72 is performed by a roller transferring method using a tape member for masking. The tape member for masking has a two-layer structure in which the masking material 72 is stacked on a tape base material 71. In the compression bonding, a pressing member such as a roller 75 is moved relative to the ink-ejection face 2*a* in the main scanning direction. The masking material 72 faces and is held in contact with the ink-ejection face 2*a* at a nipping position of the roller 75, and the tape base material 71 is pressed from a back face (a lower face in FIG. 9) thereof toward the ink-ejection face 2*a*. A pressing force during the relative movement is constant. In the present embodiment, each of the grooves 109*a* is disposed adjacent to one of the grooves 109*a* or one of the dummy grooves 109*b* so as to be distant from the groove 109*a* or the dummy groove 109*b* by generally the separation distance 1*c*. Thus, in comparison with a case where only the grooves 109*a* are formed in the ink-ejection face 2*a*, amounts (i.e., depths) of the masking material 72 entering into the respective grooves 109*a* are made uniform or equal when the ink-ejection face 2*a* and the masking material 72 are compressed and bonded together. Consequently, it is possible to prevent the masking material 72 from entering the nozzle holes 108 by adjusting a pressure at which the roller 75 presses the masking material 72 via the tape base material 71.

In the water-repellent-layer removing step, a plasma etching treatment is applied to the nozzle plate 130 from the face of the nozzle plate 130 which is opposite to the ink-ejection face 2*a* having been masked in the masking-material compression-bonding step. As a result, the unnecessary water repellent layer 2*b*' formed on the inner wall face of each nozzle hole 108 which is not masked by the masking material 72 is removed.

In the masking-material stripping step, the masking material 72 is stripped or removed from the ink-ejection face 2*a* of the nozzle plate 130 from which the unnecessary water repellent layer 2*b*' has been removed in the water-repellent-layer removing step. The nozzle plate 130 is then cleaned and dried. As a result, forming the nozzle plate 130 is completed.

As described above, according to the present embodiment, the dummy grooves 109*b* are formed in the ink-ejection face 2*a* of the head 2. Thus, in comparison with a case where only the grooves 109*a* are formed in the ink-ejection face 2*a*, the amounts (i.e., the depths) of the masking material 72 entering into the respective grooves 109*a* are made uniform when the ink-ejection face 2*a* and the masking material 72 are compressed and bonded together. Consequently, it is possible to prevent the masking material 72 from entering into the nozzle holes 108 by adjusting the pressure at which the roller 75 presses the masking material 72 via the tape base material 71. As a result, it is possible to accurately remove only the water repellent layer 2*b*' formed in each nozzle hole 108, thereby suppressing the variations in the ink ejection properties among the ink-ejection openings 108*a*. Likewise, when the wiper for cleaning the ink-ejection face 2*a* is brought into contact with the ink-ejection face 2*a*, depths or distances in which the wiper enters into the respective grooves 109*a*, 109*b* can be made uniform. As a result, it is possible to efficiently clean the ink-ejection face 2*a* and to prevent the wiper and the ink-ejection face 2*a* from being partly deteriorated.

Further, the separation distance between the dummy groove 109*b* and the groove 109*a* adjacent to each other in the sub-scanning direction is the same as the separation distance between the two grooves 109*a* adjacent to each other at the shortest distance among the sixteen grooves 109*a*. Thus, it is possible to prevent the masking material 72 from entering into each groove 109*a* in a relatively large amount (i.e., a relatively great depth) at an area near the grooves 109*a* located adjacent to each other at the shortest distance.

Further, all of the six grooves 109*a* and the ten dummy grooves 109*b* have the same width, thereby making it easier to form the grooves 109*a* and the dummy grooves 109*b*. Further, the entering amounts of the masking material 72 can be made uniform.

Further, each dummy groove 109*b* has the same length as the groove 109*a* adjacent thereto and extends in parallel with the adjacent groove 109*a*. Thus, the amounts of the masking material 72 entering into the respective grooves 109*a* can be made uniform.

In addition, two of the dummy grooves 109*b* are arranged on opposite sides of each of the groove groups X1-X5 in the sub-scanning direction. Thus, the amounts of the masking material 72 entering into the respective grooves 109*a* of the groove groups X1-X5 can be reliably made uniform.

Further, each of the grooves 109*a* and the dummy grooves 109*b* is defined by the lower face of the nozzle plate 130 and the inner wall face of the corresponding elongated hole of the plated layer 131, which elongated hole exposes the ink-ejection-opening row. Thus, it is possible to easily and accurately form the grooves 109*a* and the dummy grooves 109*b*.

In addition, in the masking-material compression-bonding step, the roller 75, while contacting the tape base material 71, is rotated and moved from one to the other of opposite end portions of the ink-ejection face 2*a* in the main scanning direction such that the masking material 72 is pressed onto the ink-ejection face 2*a* in a state in which the masking material 72 held on a surface of the tape base material 71 faces the ink-ejection face 2*a*. Thus, it is possible to have the masking material 72 uniformly enter into the grooves 109*a*.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, the separation distance between the dummy groove 109*b* and the groove 109*a* adjacent to each other in the sub-scanning direction is the same as the separation distance between the two grooves 109*a* adjacent to each other at the shortest distance among the pairs of the sixteen grooves 109*a*, but this printer 1 is not limited to this configuration. For example, any distance can be used as the separation distance between the dummy groove 109*b* and the groove 109*a* adjacent to each other in the sub-scanning direction as long as the separation distance between the dummy groove 109*b* and the groove 109*a* adjacent to each other in the sub-scanning direction is equal to or greater than the separation distance between the two grooves 109*a* adjacent to each other at the shortest distance among the pairs of the sixteen grooves 109 and is shorter than a separation distance between two grooves 109*a* adjacent to each other at the greatest distance among the pairs of the sixteen grooves 109.

Further, in the above-described embodiment, all of the six grooves 109*a* and the ten dummy grooves 109*b* have the same width, but this printer 1 is not limited to this configuration. For example, at least ones of the grooves 109*a* and the dummy grooves 109*b* may have different widths.

Further, in the above-described embodiment, each dummy groove 109*b* has the same length in the main scanning direction as the groove 109*a* adjacent thereto in the sub-scanning direction and extends in the main scanning direction in parallel with the adjacent groove 109*a*, but this printer 1 is not limited to this configuration. For example, at least one dummy groove 109*b* may have a length different from that of the groove 109*a* adjacent thereto and extend in parallel with the adjacent groove 109*a*, in this configuration, where the dummy groove 109*b* is made longer in the main scanning direction than the groove 109*a* adjacent thereto, the entering amounts of the masking material 72 can be made uniform in the compression bonding.

In addition, in the above-described embodiment, two of the dummy grooves 109*b* are arranged on opposite sides of each of the groove groups X1-X5 in the sub-scanning direction, but this printer 1 is not limited to this configuration. For example, one dummy groove 109 may be arranged on only one side of each of the groove groups X1-X5 in the subscanning direction and may be arranged between adjacent two of the grooves 109 of the groove groups X1-X5.

Further, in the above-described embodiment, each of the grooves 109*a* and the dummy grooves 109*b* is defined by the lower face of the nozzle plate 130 and the inner wall face of the corresponding elongated hole of the plated layer 131, which elongated hole exposes the ink-ejection-opening row, but this printer 1 is not limited to this configuration. For example, each of the grooves 109*a* and the dummy grooves 109*b* may be formed by performing a cutting work or an etching work for the nozzle plate 130.

In addition, in the above-described embodiment, in the masking-material compression-bonding step, the roller 75, while contacting the tape base material 71, is rotated and moved from one to the other of the opposite end portions of the ink-ejection face 2*a* in the main scanning direction such that the masking material 72 is pressed onto the ink-ejection face 2*a* in the state in which the masking material 72 held on the surface of the tape base material 71 faces the ink-ejection face 2*a*, but this printer 1 is not limited to this configuration. For example, the head 2 may be moved in a state in which the roller 75 is fixed. Further, any mechanism may be used as a mechanism for pressing the masking material 72 onto the ink-ejection face 2*a*. For example, a pressing member having a pressing face may be used to press the masking material 72 onto an entire area of the ink-ejection face 2*a*.

In the above-described embodiment, the pressure at which the roller 75 presses the masking material 72 is adjusted in the compression bonding of the masking material 72 such that the masking material 72 is prevented from entering into the nozzle holes 108, but this printer 1 is not limited to this configuration. For example, the masking material 72 may be compressed and bonded at a pressing pressure that allows the masking material 72 to enter into the nozzle holes 108. Where this printer 1 is configured in this manner, the water repellent layer 2*b* in the nozzle holes 108 partly remains near the respective ink-ejection openings 108*a*. However, since remaining amounts of the water repellent layer 2*b* (i.e., depths from the ink-ejection openings 108*a*) are equal, uniform ink ejection properties can be obtained as in the above-described embodiment.

Further, in the above-described embodiment, the separation distance lx between each dummy groove 109*b* and the corresponding groove 109*a* nearest to the dummy groove 109*b* in the sub-scanning direction is made equal to the separation distance lc between the adjacent two grooves 109*a* which are the nearest among all pairs of the grooves 109*a*, but this printer 1 is not limited to this configuration. For example, the separation distance lx between each dummy groove 109*b* and the corresponding groove 109*a* nearest to the dummy groove 109*b* in the sub-scanning direction may be different from the separation distance lc between the adjacent two grooves 109*a* which are the nearest among all pairs of the grooves 109*a*, as long as the variation of the amounts of the masking material 72 entering into the respective grooves 109*b* is within an acceptable range when the masking material 72 is compressed and bonded. For example, the separation distance lx between each dummy groove 109*b* and the corresponding groove 109*a* nearest to the dummy groove 109*b* in the sub-scanning direction may be made equal to an average value among the smallest values each of which is the smallest value of the separation distances each between corresponding two of the grooves 109*a* adjacent to each other in a corresponding one of the groove groups X1-X5. Alternatively, the separation distance lx between each dummy groove 109*b* and the corresponding groove 109*a* nearest to the dummy groove 109*b* in the sub-scanning direction may be made equal to an average value among the separation distances each between corresponding two of the grooves 109*a* adjacent to each other in the groove groups X1-X6.

In the above-described embodiment, the present invention is applied to the head 2 configured to eject the ink droplets, but the present invention is also applicable to any liquid ejection head configured to eject liquid other than the ink.

What is claimed is:

1. A liquid ejection head comprising:

a base plate member; and an actuator configured to apply liquid ejection energy to liquid in the base plate member;

wherein the base plate member has (a) a plurality of ejection holes formed in a thickness direction of the base plate member and (b) an ejection face having a plurality of ejection openings opened therein, wherein liquid droplets are ejected through the plurality of ejection holes and the plurality of ejection openings;

wherein the ejection face has a plurality of first recessed portions and a plurality of second recessed portions each of which extends in one direction and which are formed in the ejection face so as to be arranged in parallel with one another in a recessed-portions arranged direction that is perpendicular to the one direction, wherein the plurality of ejection openings are formed in bottom portions of the respective first recessed portions and each of the plurality of second recessed portions is a dummy groove having a bottom portion in which the plurality of ejection openings are not formed; and wherein each of the plurality of second recessed portions and a corresponding one of the plurality of first recessed portions are arranged side by side such that a separation distance therebetween in the recessed-portions arranged direction is equal to or greater than a separation distance in the recessed-portions arranged direction between two first recessed portions located side by side at the shortest distance among the plurality of first recessed portions and is shorter than a separation distance in the recessed-portions arranged direction between two first recessed portions located side by side at the greatest distance among the plurality of first recessed portions, wherein the corresponding one of the plurality of first recessed portions is nearest to said each of the plurality of second recessed portions among the plurality of first recessed portions.

2. The liquid ejection head according to claim 1, wherein the separation distance in the recessed-portions arranged direction between the corresponding one of the plurality of first recessed portions and said each of the plurality of second recessed portions located side by side is the same as the separation distance in the recessed-portions arranged direction between the two first recessed portions located side by side at the shortest distance among the plurality of first recessed portions.

3. The liquid ejection head according to claim 1, wherein a length of said each of the plurality of second recessed portions is the same in the one direction as that of the corresponding one of the plurality of first recessed portions that is adjacent to said each of the plurality of second recessed portions in the recessed-portions arranged direction.

4. The liquid ejection head according to claim 1, wherein a length of each of the first recessed portions in the recessed-portions arranged direction is the same as a length of each of the second recessed portions in the recessed-portions arranged direction.

5. The liquid ejection head according to claim 1, wherein the first recessed portions are arranged so as to provide a plurality of first-recessed-portion groups each constituted of first recessed portions, which are arranged successively adjacent to one another in the recessed-portions arranged direction at intervals of distances that are shorter than the separation distance between the two first recessed portions located side by side at the greatest distance among the plurality of first recessed portions, and wherein the second recessed portions are disposed on each of opposite sides of each of the first-recessed-portion groups in the recessed-portions arranged direction.

6. The liquid ejection head according to claim 1, wherein each of the first recessed portions is defined by (a) a nozzle plate of the base plate member in which the plurality of ejection openings are opened and (b) a plated layer formed on the nozzle plate so as to expose the plurality of ejection openings.

7. The liquid ejection head according to claim 1, wherein bottom portions of the respective first recessed portions is covered by a liquid repellent layer which has not been removed due to a masking material having entered into the first recessed portions to cover the liquid repellent layer.

8. The liquid ejection head according to claim 7, wherein the masking material covers the liquid repellent layer by being compressed and bonded to the ejection face, wherein the liquid repellent layer not covered by the masking material is removed, and wherein the masking material is removed after the liquid repellent layer not covered by the masking material has been removed.

9. The liquid ejection head according to claim 7, wherein the liquid repellent layer is formed by applying a water repellent agent by spraying.

10. The liquid ejection head according to claim 7, wherein the liquid repellent layer not covered by the masking material is removed by a plasma etching treatment applied from the other side of the base plate member from the ejection face.

11. The liquid ejection head according to claim 8, wherein the masking material is compressed and bonded to the ejection face by a pressing member moving relative to the base plate member in the one direction while pressing the masking material onto the ejection face.

12. The liquid ejection head according to claim 11, wherein the masking material is formed by a roller transferring method using a tape base material on which the masking material is stacked, wherein the tape base material has opposite faces, one of which contacts the masking material, and wherein the pressing member is configured to press the tape base material from the other of the opposite faces of the tape base material.

* * * * *